US006698616B2

(12) United States Patent
Hidle et al.

(10) Patent No.: US 6,698,616 B2
(45) Date of Patent: Mar. 2, 2004

(54) ELECTRONIC LIQUID DISPENSER

(75) Inventors: Rex A. Hidle, San Antonio, TX (US); Paul H. Dorman, Fort Worth, TX (US); Martin E. Smith, Camarillo, CA (US); Earl R. Boyer, Simi Valley, CA (US); Stuart Daley, Camarillo, CA (US); Shawn B. Gentry, Kellar, TX (US)

(73) Assignee: HealthPoint, Ltd., Forth Worth, TX (US)

( * ) Notice: Subject to any disclaimer, the term of this patent is extended or adjusted under 35 U.S.C. 154(b) by 0 days.

(21) Appl. No.: 10/166,452

(22) Filed: Jun. 10, 2002

(65) Prior Publication Data

US 2003/0226853 A1 Dec. 11, 2003

(51) Int. Cl.[7] ..... G01F 11/00

(52) U.S. Cl. ..... 222/1; 222/61; 222/644; 222/397

(58) Field of Search ..... 222/1, 61, 63, 222/644, 181.3, 394, 397

(56) References Cited

U.S. PATENT DOCUMENTS

| | | | | |
|---|---|---|---|---|
| 5,255,822 A | * | 10/1993 | Mease et al. | 222/63 |
| 5,507,413 A | * | 4/1996 | Chen | 222/63 |
| 6,161,726 A | * | 12/2000 | Parsons et al. | 222/52 |
| 6,209,752 B1 | * | 4/2001 | Mitchell et al. | 222/63 |
| 6,367,662 B1 | | 4/2002 | Dorman et al. | |
| 6,390,329 B1 | * | 5/2002 | Maddox | 222/25 |
| 6,390,340 B1 | * | 5/2002 | Lynch, Sr. | 222/399 |

FOREIGN PATENT DOCUMENTS

WO PCT-WO 01/74225 A1 10/2001

* cited by examiner

*Primary Examiner*—Joseph A. Kaufman
(74) *Attorney, Agent, or Firm*—McKee, Voorhees & Sease, P.L.C.

(57) ABSTRACT

The present invention discloses a method, apparatus and system for electromechanical liquid dispensing. The system includes a bottle for holding liquid to be dispensed, the bottle having an inlet port and an outlet port, a one-way outlet valve on the outlet port through which liquid is dispensed from the bottle, and an electronic control system for controlling dispensement of the liquid from the outlet port such that a controlled quantity of liquid is dispensed.

18 Claims, 5 Drawing Sheets

ELECTRONIC LIQUID DISPENSER

BACKGROUND OF THE INVENTION

This invention relates to a liquid dispenser. More specifically, and without limitation, this invention relates to an electronically controlled liquid dispenser for dispensing liquid from a bottle.

Liquid dispensers for various liquid products are well known and generally include a container for holding the liquid, with a discharge port through which the liquid is dispensed. A common problem with many prior art dispensers is leakage or dripping of the liquid from the bottle after a desired liquid volume has been discharged or dispensed. Another problem with prior art dispensers is the inability to dispense 100% of the liquid from the bottle. Rather, dispensers typically retain 5–10% of the liquid in the bottle after the bottle is "emptied." A further problem with prior art medical dispensers is the inability to dispense the desired amount or dosage.

There are also problems related to the use of soap or scrub that without the benefit of this disclosure would seem to be unrelated to liquid dispensers. One such problem relates to the diligence of a person in applying soap or surgical scrub. Even if such a liquid is dispensed, in order for it to perform its intended function it may need to be thoroughly applied. For example, where a person seeks to apply surgical scrub as an antiseptic, the person must thoroughly scrub their hands and arms with the antiseptic liquid in order for it to fulfill its intended purpose. If a person does not rub the antiseptic into their hands, finger nails, cuticles and forearms for a sufficient time period then microorganisms including viruses and bacteria are not removed.

Similarly, for proper antiseptic use it may be advisable to rinse, and then reapply an amount of the liquid and repeat the scrubbing process. Failure to scrub for the proper time period or to repeat the process can have an adverse affect on the efficiency of the scrubbing process.

Further, if the person touches the liquid dispenser in order to dispense liquid a second time, then that person may introduce new microorganisms onto their hands, thus negating at least a portion of the effect of the liquid in the first place.

Therefore, it is a primary object of the present invention to provide a liquid dispenser that improves upon the state of the art.

Another object of the present invention is to provide a liquid dispenser that does not leak or drip liquid after a desired volume has been dispensed.

A further object of the present invention is to provide a liquid dispenser that dispenses 100% of the liquid in a bottle.

Yet another object of the present invention is to provide a liquid dispenser particularly for medical uses that accurately dispenses a desired dosage of a liquid from a bottle.

A further object of the present invention is to provide a liquid dispenser that dispenses liquid without requiring a person to come in contact with the liquid dispenser.

A still further object of the present invention is to provide a liquid dispenser that encourages a person using the dispenser to thoroughly apply the dispensed liquid.

Another object of the present invention is to provide a liquid dispenser that encourages a person to apply a liquid more than once.

Yet another object of the present invention is to provide a liquid dispenser that uses pneumatic pressure for product dispensing.

A further object of the present invention is to provide a liquid dispenser that can be a closed system that requires no external input or apparatus.

These and/or other objects, features or advantages of the present invention will become apparent from the specification and claims.

SUMMARY OF THE INVENTION

The present invention includes a liquid dispenser for dispensing liquid from a bottle, the bottle having an inlet port and an outlet port, with liquid being dispensed through the outlet port. According to the present invention, the liquid dispenser includes an air manifold fluidly connected to the inlet port and an air pump fluidly connected to the air manifold for providing compressed air. An electrical control system is electrically connected to the air pump for controlling the dispensing of the liquid. Preferably, there is a solenoid in operative contact with the air manifold for releasing air from the air manifold so that a precise amount of liquid can be dispensed. Also, preferably the liquid dispenser includes a proximity detection system electrically connected to the electrical control system so that when objects such as person's hands are placed underneath the outlet port of the liquid dispenser, liquid can be automatically dispensed.

The present invention also provides for a process of dispensing liquid from a bottle that has an inlet port and an outlet port. The method includes detecting an object that is proximate the outlet port, then pumping air through the inlet port so as to pressurize air within the bottle and thereby dispense a first flow of liquid through the outlet valve, and then releasing pressure in the bottle thereby stopping the flow of liquid through the outlet valve.

According to one aspect of the present invention, the liquid dispenser includes a built-in scrub timer for delaying for a time period after a first dispensement of liquid and before a second dispensement of liquid. This encourages proper scrubbing. Further, one aspect of the present invention provides for dispensing the liquid only when objects (such as a person's hands) are placed under the outlet port of the liquid dispenser.

Thus, the liquid dispenser of the present invention provides advantages such as automatic dispensing of liquid, dispensing of a controlled amount of liquid, and controlling the dispensement of a liquid in a manner that encourages proper repetition of the scrub, rinse, and repeat process.

DETAILED DESCRIPTION OF THE INVENTION

Figure 1:
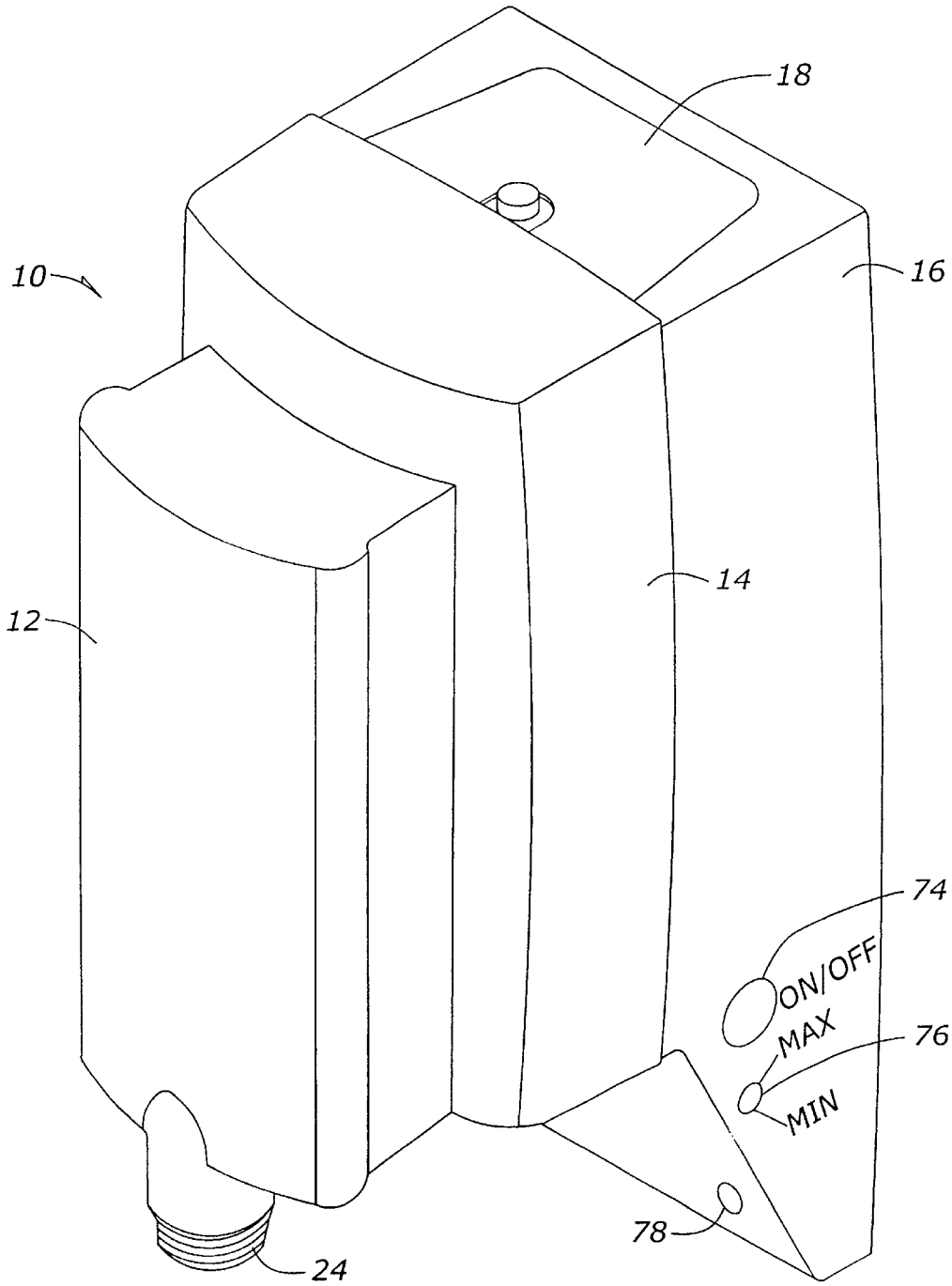
FIG. 1 is a perspective view of the liquid dispenser of the present invention.

The dispenser of the present invention is generally designated by the reference numeral 10 in the drawings. The dispenser 10 generally includes a bottle 12 for containing liquid to be dispensed, and a fixture 14 in which the bottle 12 is mounted. The fixture 14 is then mounted to a base 16. The base 16 can be mounted on a wall. A battery compartment 18 is disposed within the base such that it is readily accessible for replacement of batteries without requiring that the liquid dispenser be removed from a wall. Although a battery compartment is shown, the present invention contemplates that electrical energy may otherwise be supplied.

Also shown in FIG. 1 is an on/off switch 74. A volume adjustment control or setting 76 is also shown. In addition, an LED or other display 78 is shown. Preferably, where an LED is used, the LED is a two-toned LED. According to one embodiment, the LED will emit a green light which will eliminate for approximately 8 seconds when power is turned on and illuminate at activation and while soap is dispensing. A blinking red light can appear when the batteries are low and a constant red light can be used to indicate a malfunction.

Figure 2:
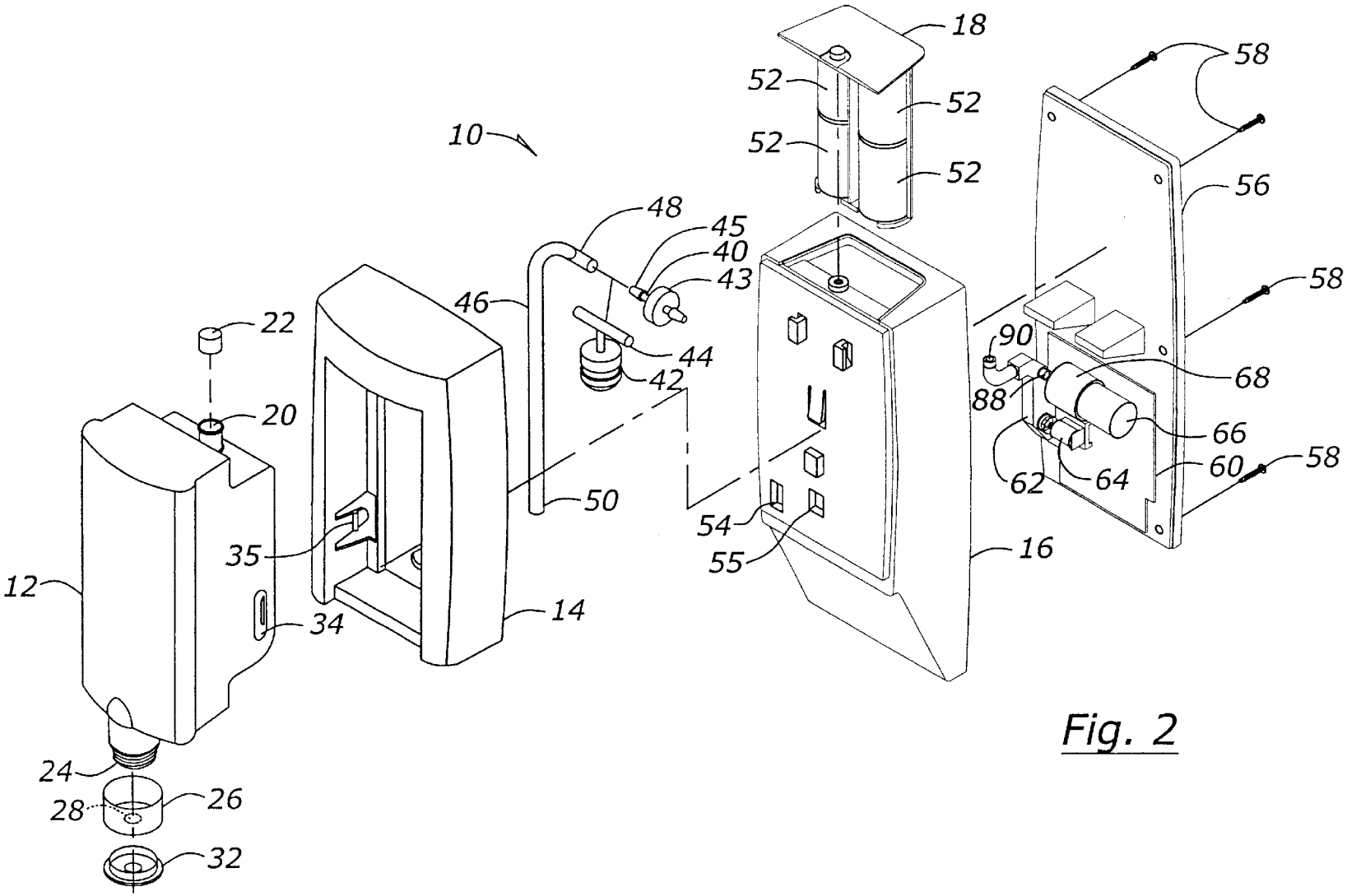
FIG. 2 is an exploded view of the liquid dispenser of the present invention.

As best shown in the exploded view of FIG. 2, the bottle 12 includes an inlet port 20, which may be capped with inlet cap 22. When the liquid dispenser 10 of the present invention is assembled with the bottle 12 in place, the inlet cap 22 is removed.

The bottle 12 also includes an outlet port 24 having an outlet cap 26. The cap 26 has an opening therein which is normally closed by a self-sealing, non-drip valve 28. The valve 34 preferably includes a silicon membrane with cross air slits transecting the membrane. Such a valve is commercially available and commonly known as a zell valve. A removable lid 32 is provided for the outlet cap 26 to enclose the valve 28 for storage and transport of the bottle 12. In addition, the bottle 12 contains a recess 34 that is retentively engaged by spring clip 35 to secure the bottle 12 in the fixture 14.

A one-way air valve and/or a solid plug 42 is mounted in the fixture 14. The air valve 42 provides an air tight seal with the inlet port 20 of the bottle 12 when the bottle 12 is mounted in the fixture 14. A t-branch 44 is provided to connect the air valve 42 in line with a tube 46 having a first end 48 and a second end 50. The t-branch 44 also connects to a one-way air valve 43 having an air inlet end 45 and an air filter 40 disposed therein. The tube 46 has a first end 48 connected to the t-branch 44 and also a second end 50.

The fixture 14 is attached to the base 16 and preferably is attached in an easily removable manner, such as through using a spring clip or other slidable inner locking assembly. The base 16 contains the removable battery compartment 18 with batteries 52. In addition, the base 16 contains an opening 54 for providing access to the end 50 of tube 46.

The base 16 can also include a bottle detection sensor or switch 55. The bottle detector can be a contact switch such that when a bottle is in place the switch 55 is activated. Thus, the control system of the present invention can determine whether or not a bottle is present at any given time or can tell if a bottle has been removed and replaced.

The base backing 56 is attached to the base 16 such as through the use of screws 58 or other fasteners. On the base backing 56, a circuit board 60 is mounted. Also mounted on the circuit board assembly 60 is an air manifold 62 in operative connection with a solenoid 64 and a motor 66 and attached pump 68. The air pump 68 creates pressurized flow of air through tube 88 into the inner manifold 62 and the air manifold outlet 90. When the liquid dispenser is assembled, the air manifold outlet 90 protrudes through the opening 54 of the base 16 and connects to the end 50 of tube 46 for providing pressurized air into the bottle 12.

Figure 3:
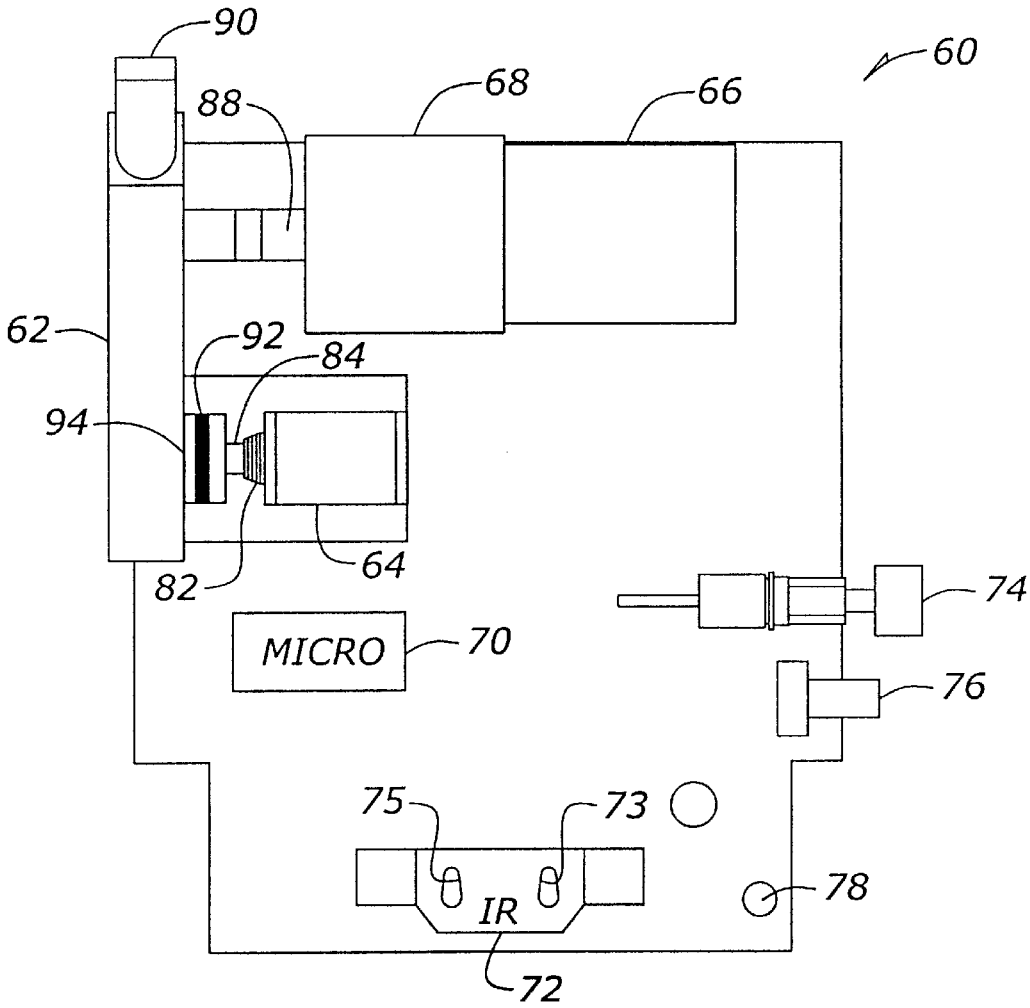
FIG. 3 is a pictorial representation of the circuit board of the liquid dispenser of the present invention.

FIG. 3 provides a pictorial representation of the circuit board assembly 60. The motor 66 drives the air pump 68 to pump air through tube 88 into the air manifold 62. A solenoid 64 having a spring 82 and a rod 84 is also placed in operative contact with a seal 92. When the solenoid 64 is in an actuated position with the rod 84 extended the seal 92 seals the air manifold so that air does not escape.

Also on circuit board assembly 60 is an electronic control such as a microcontroller 70. The microcontroller 70 is electrically connected to the motor 66 for activating the motor 66 and air pump 68. The microcontroller 70 is also electrically connected to the solenoid 64 for controlling actuation of the solenoid. The microcontroller 70 can be an 8 bit microcontroller such as available from Microchip such as a PIC 16F627. The present invention, however, contemplates use of, but is not limited to any particular microcontroller, integrated circuit, portion of an integrated circuit, controller, processor, or discrete control circuit.

Also on the circuit board assembly 60 is an on/off switch 74, a liquid dispensing quantity adjustment control 76 such as a variable resistor, a visual feedback display such as an LED 78, and a proximity detection system such as an infrared emitter/detector 72. The infrared emitter/detector 72 emits infrared light and receives reflections of infrared light. Therefore, the infrared emitter/detector pair can emit infrared light and then detect whether that infrared light has been reflected off of an object. For example, if a person's hands were underneath the infrared emitter/detector 72 then infrared light emitted from the infrared emitter 73 would be reflected off the person's hands and received by the infrared receiver 75.

Figure 4:
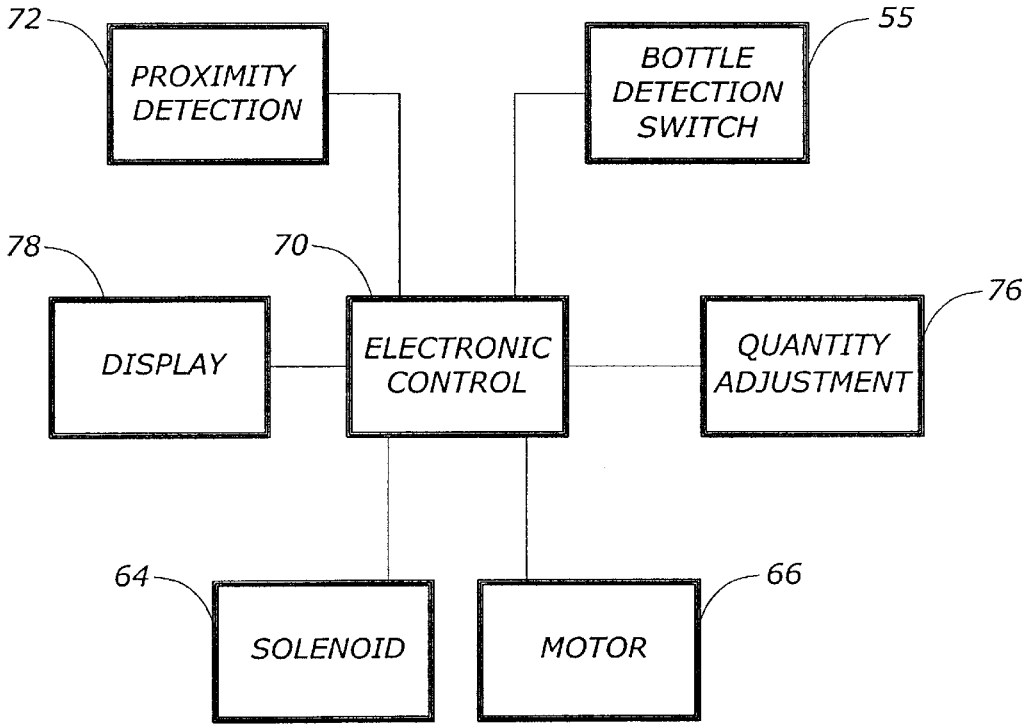
FIG. 4 is a block diagram of the control system of the liquid dispenser of the present invention.

FIG. 4 shows a block diagram of the control system of the present invention. As shown in FIG. 4, the electronic control 70 is electrically connected to a proximity detection system 72. Preferably the proximity detection system is an infrared emitter/receiver. However, the present invention contemplates any number of types of proximity detection that rely upon light, ultrasonics, or other technologies.

The electronic control 70 is also electrically connected to a quantity adjustment 76. By adjusting the quantity adjustment 76, the electronic control can increase or decrease the amount or quantity of liquid dispensed. Where the electronic control 70 is a microcontroller with a built-in analog to digital converter, the quantity adjustment can be implemented through using a variable resistor such that as the variable resistor is adjusted, a voltage level received by the electronic control 70 is adjusted so that the electronic control 70 can adjust the quantity of liquid dispensed based upon the resistance of the variable resistor the present invention, however, contemplates that the quantity of liquid to be dispensed can otherwise be controlled.

The motor 66 is also electrically connected or otherwise in operative communication with the electronic control 70 such that the electronic control 70 can turn on or off the motor 66 thereby causing air to be pumped into a bottle when the motor 66 is activated. In addition, the solenoid 64 is electrically connected to the electronic control 70 so that the solenoid can be actuated by the electronic control 70 in order to release air.

The use of the electronic control 70 provides great flexibility in the operation of the liquid dispenser. In particular, the electronic control 70 allows for precise quantities of liquid to be dispensed. The electronic control 70 can turn the motor 66 on for a precise amount of time so that a corresponding amount of liquid is dispensed. In addition, the electronic control 70 can monitor the proximity detection system 72. Thus, the electronic control 70 can activate the motor 66 and dispense liquid after an object has been detected. So, for instance, a person can put their hands underneath the liquid dispenser thereby activating the proximity detection system 72 that is monitored by the electronic control 70 which in turn, turns on the motor 66 to dispense liquid. The electronic control 70 can also include one or more timers. The use of timers further provides the present invention with additional features. For example, according to the present invention, after a first quantity of liquid is dispensed, the electronic control 70 can wait for a given time period and then dispense a second quantity of liquid. Where the liquid dispenser contains soap or surgical scrub this encourages an operator to repeat the scrubbing process. Further, the electronic control 70 is preferably configured such that soap or surgical scrub is not dispensed when the proximity detection system 72 does not detect hands underneath the liquid dispenser.

The present invention also provides for an optional bottle detection switch 55 electrically connected to the electronic control 70. The bottle detection sensor switch can be of numerous types, including a contact switch. When a bottle detection switch 55 is used, the electronic control 70 can detect when a bottle has been removed and when a new bottle has been inserted into the device. The present invention contemplates that as the amount of liquid in the bottle decreases, the motor 66 will need to be turned on for an increased amount of time in order to build sufficient pressure to dispense the same amount of liquid. Thus, the present invention provides for maintaining precise dosages of liquid even as the supply of liquid in the bottle depletes over time.

The present invention also provides for a display 78 electrically connected to the electronic control 70. The display can be an LED or other type of display. Where an LED is used, the LED can be activated prior to the second dispensement of liquid to provide notice to the operator that liquid will soon be dispensed so that the operator can place their hands underneath the outlet of the bottle. The LED is preferably a two-tone LED. For example, the LED can display both green and red. The green light can be used to illuminate for a time period, such as approximately 8 seconds, when the power is turned on and to illuminate upon activation and while the soap is dispensing. The green light can continue to blink for a time period, such as 90 seconds, after the soap has last been dispensed. Once a user places their hands underneath the dispenser while the green light is blinking, the dispenser dispenses a second dose of liquid. A blinking red light can be used when the batteries are low and need to be replaced with the next bottle change. A constant red light can be used when a unit detects a malfunction. The present invention also contemplates that instead of a display 78, other types of alert or notice could be used, including sound, light or other implementations. Where an intelligent control having an instruction set is used, the instruction set includes instructions for controlling the display.

When the electronic control 70 of the present invention includes a microcontroller, processor, or other intelligent control device, the electronic control 70 can have an instruction set so that electronic control of the dispensing process is controlled by these instructions. The instructions provide for determining that the liquid should be dispensed, dispensing a first amount of the liquid, delaying for a time period, and dispensing a second amount of the liquid. In addition, electronic control 70 preferably includes instructions for determining the amount of time the motor should be operated in order to dispense a particular amount of liquid. As the bottle is depleted, the amount of time required to build up sufficient air pressure to dispense the same amount of liquid also increases. The present invention increases the motor run time such that the first does of liquid is of the same size as the last dose of liquid.

Figure 5:
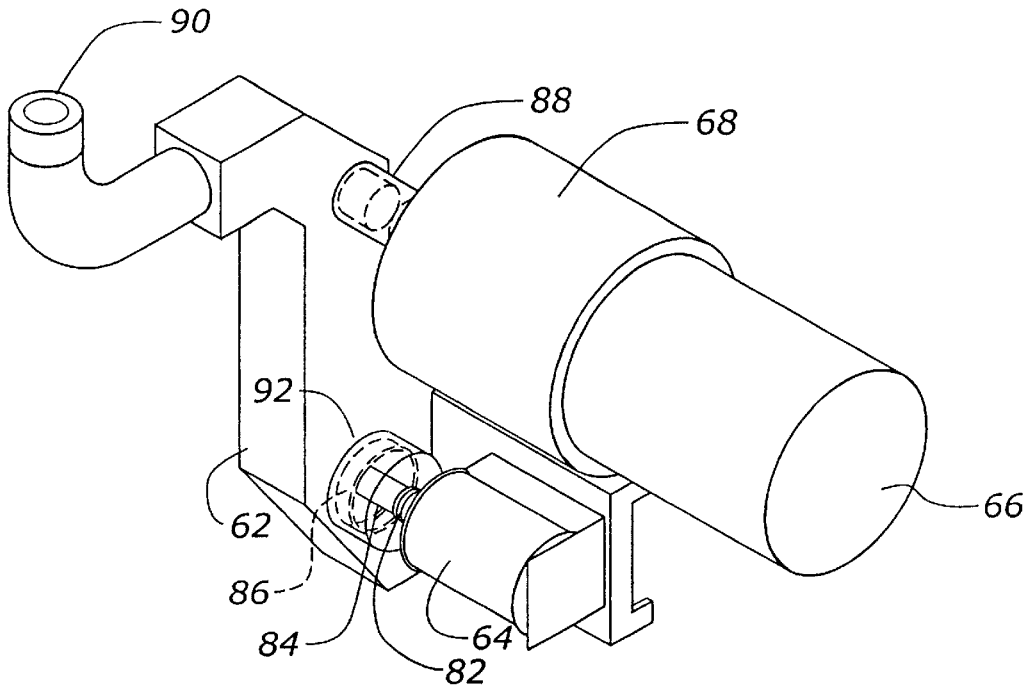
FIG. 5 is a perspective view illustrating the pump, solenoid, and manifold assembly of the liquid dispenser of the present invention.

FIG. 5 shows the motor 66, pump 68, solenoid 64, and manifold 90 assembly in greater detail. The motor 66, when turned on, causes the pump 68 to pump air through the tube 88 and into the air manifold 62. The solenoid 64 with spring 82 on the shaft 84, has a seal 86 used to seal an outlet 92 of the air manifold. When the solenoid is actuated such that the rod 84 is extended, the outlet 92 of the air manifold 62 is sealed so that air can be forced through the tubes and the bottle, resulting in the dispensement of liquid from the bottle. When the motor 66 and pump 68 are turned off and the solenoid 64 is turned off so that the rod 84 returns to its original position, the seal 86 no longer seals the outlet 92 of the air manifold 62. Thus, pressurized air is immediately released from the air manifold 62 and liquid ceases to be dispensed. This configuration results in precise control of the amount of liquid dispensed from the bottle.

Thus, according to a method of the present invention once an object is detected air can be pumped through the inlet port of the bottle so as to pressurize air within the bottle and thereby dispense a flow of liquid through the outlet valve of the bottle. According to the present invention, pressure in the bottle can be released by stopping the flow of liquid through the valve. Preferably 100% of the pressure is released and slow bleed-off is avoided. The present invention also provides for then delaying for a time period and then pumping air again so as to dispense a second quantity of liquid. Preferably, the second quantity of liquid is not dispensed until the user's hands are detected underneath the outlet of the bottle. Further, the invention provides for an alert that the liquid dispenser is almost ready to resume a second dispensement of liquid.

Therefore a liquid dispenser has been disclosed. The liquid dispenser of the present invention provides for the advantages of dispensing a controlled quantity of liquid, dispensing liquid without requiring a person to physically contact the liquid dispenser, dispensing liquid multiple times to encourage proper scrubbing, and other advantages. Further, the present invention contemplates numerous variations in its specific configuration and implementation. The preferred embodiment of the present invention set forth in the drawings and specification may employ specific terms, however these are used in a generic or descriptive sense only and are not used for purposes of limitation. Changes in the form and proportion of parts as well as a substitution of equivalence are contemplated as circumstances may suggest or render expedient without departing from the spirit and scope of the invention as further defined in the following claims.

What is claimed is:

1. A liquid dispenser for dispensing liquid from a bottle having an inlet port and the outlet port, and a one-way outlet valve on the outlet port through which the liquid is dispensed from the bottle, conprising:

an air manifold fluidly connected to the inlet port;

an air pump fluidly connected to the air manifold for providing compressed air;

a solenoid in operative contact with the air manifold for releasing air from the air manifold; and an electrical control system electrically connected to the air pump and the solenoid for controlling dispensing of the liquid.

2. The liquid dispenser of claim 1 further comprising a proximity detection system electrically connected to the electrical control system.

3. The liquid dispenser of claim 1 wherein the electrical control system includes an intelligent control having an instruction set.

4. The liquid dispenser of claim 3 wherein the instruction set includes instructions for:

(a) determining that the liquid should be dispensed;

(b) dispensing a first amount of the liquid;

(c) delaying for a time period; and (d) dispensing a second amount of the liquid.

5. The liquid dispenser of claim 4 further comprising a proximity detection system and wherein the instructions for determining that the liquid should be dispensed are instructions for determining that the proximity detection system has triggered.

6. The liquid dispenser of claim 5 wherein the proximity detection system includes an infrared emitter and an infrared detector.

7. The liquid dispenser of claim 4 wherein the time period is a period of time between dispensing the first amount of liquid and detecting a use's hands beneath the outlet port.

8. A liquid dispensing system, comprising:

a bottle for holding liquid to:be dispensed, and having an inlet port and an outlet port;

a one-way outlet valve on the outlet port through which liquid is dispensed from the bottle;

an electronic control system for controlling dispensement of the liquid from the outlet port such that a controlled quantity of the liquid is dispensed; and wherein the electronic control system includes a timer adapted to provide a delay such that after a first quantity of the liquid is dispensed, the delay occurs and then a second quantity of the liquid is dispensed.

9. The liquid dispensing system of claim 8 wherein the electronic control system includes an intelligent control, the timer being implemented in the intelligent control.

10. The liquid dispensing system of claim 8 wherein the electronic control system includes a proximity detector for determining movement of a user's hands underneath the outlet port.

11. The liquid dispensing system of claim 8 further comprising an air pump electrically connected to the electronic control system and fluidly connected to the inlet port of the bottle for pressurizing air within the bottle and thereby force liquid through the outlet valve.

12. A method of dispensing liquid from a bottle, the bottle having an inlet port and an outlet port with a one-way valve operatively associated therewith, the method comprising:

detecting an object proximate the outlet port through a proximity detection system; pumping air through the inlet port so as to pressurize air within the bottle and thereby dispense a first flow of liquid through the outlet valve; and releasing pressure in the bottle thereby stopping the first flow of liquid through the outlet valve.

13. The method of claim 12 further comprising delaying a time period and then pumping air through the inlet port so as to pressurize air within the bottle and thereby dispense a second flow of liquid through the outlet valve.

14. The method of claim 13 further comprising providing a first visual alert during the step of delaying.

15. The method of claim 14 wherein the first visual alert is an LED.

16. The method of claim 12 wherein the step of detecting is detecting an object proximate the outlet port through use of an infrared emitter and detector.

17. The method of claim 12 wherein the step of pumping air is pumping air with an electric air pump through the inlet port so as to pressurize air within the bottle and thereby dispense a first flow of liquid through the outlet valve.

18. The method of claim 12 wherein the step of releasing pressure is deactivating a solenoid to release pressure in the bottle thereby stopping the first flow of liquid through the outlet valve.

* * * * *

UNITED STATES PATENT AND TRADEMARK OFFICE

CERTIFICATE OF CORRECTION

PATENT NO. : 6,698,616 B2
DATED : March 2, 2004
INVENTOR(S) : Rex A. Hidle et al.

It is certified that error appears in the above-identified patent and that said Letters Patent is hereby corrected as shown below:

Column 6,
Line 56, “conprising” should be -- comprising --

Column 7,
Line 19, “use’s” should be -- user’s --
Line 21, “to:be” should be -- to be --

Signed and Sealed this

Twenty-ninth Day of June, 2004

JON W. DUDAS
*Acting Director of the United States Patent and Trademark Office*